US005881435A

United States Patent [19]

Jermyn, Jr.

[11] Patent Number: 5,881,435

[45] Date of Patent: Mar. 16, 1999

[54] TIE STRAP DEVICE HAVING LOCKING HEAD WITH LINE OF WEAKNESS

[76] Inventor: Richard A. Jermyn, Jr., 4400 Bluewater Dr., Panama City, Fla. 32404-5203

[21] Appl. No.: 107,602

[22] Filed: Jun. 30, 1998

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P, 3.4

[56] References Cited

U.S. PATENT DOCUMENTS

| | | | |
|---|---|---|---|
| 3,086,265 | 4/1963 | Orenick et al. | 24/30.5 |
| 3,147,522 | 9/1964 | Schumm | 24/16 |
| 3,206,814 | 9/1965 | Schumm | 24/20 |
| 3,339,247 | 9/1967 | Geisinger | 24/16 |
| 4,263,697 | 4/1981 | Speedie | 24/30.5 P |
| 4,418,448 | 12/1983 | Sauer | 24/20 TT |
| 4,468,840 | 9/1984 | Sauer et al. | 24/20 R |
| 4,501,049 | 2/1985 | Adamson | 24/17 AP |
| 5,123,913 | 6/1992 | Wilk et al. | 606/232 |
| 5,363,536 | 11/1994 | Kleemann | 24/345 P |

FOREIGN PATENT DOCUMENTS

| | | | |
|---|---|---|---|
| 1212605 | 3/1960 | France | 24/16 PB |

*Primary Examiner*—Victor N. Sakran

*Attorney, Agent, or Firm*—Flanagan & Flanagan; John K. Flanagan; John R. Flanagan

[57] ABSTRACT

A tie strap device is in the form of an elongated body of substantially yieldably resilient deformable and reformable material. The elongated body includes a strap and a locking head. The strap has opposite longitudinal surfaces and opposite ends. The locking head is formed at one end of the strap while the other end of the strap is free. The locking head defines a cavity therethrough having an interior surface. The locking head has portions which are connected together and define a line of weakness in the locking head in communication with the cavity. The line of weakness allows for separation of the portions from one another and forcible removal of the strap from the cavity in response to a pulling force applied by the strap on the locking head at the line of weakness. The elongated body also has retention elements defined on the interior surface of the locking head and on one of the opposite longitudinal surfaces of the strap for forming a locking engagement between the strap and locking head and thereby preventing withdrawal of the strap from the cavity in a direction opposite to a direction of insertion of the strap through the cavity.

20 Claims, 2 Drawing Sheets

TIE STRAP DEVICE HAVING LOCKING HEAD WITH LINE OF WEAKNESS

BACKGROUND OF THE INVENTION

FIELD OF THE INVENTION

The present invention generally relates to tie straps and, more particularly, is concerned with a tie strap device having a locking head defining a line of weakness.

DESCRIPTION OF THE PRIOR ART

It is often desirable to carry any of a variety of items in bundles or in bags. These bundles and bags may need to be tied so that the items stay together in bundle form and so that an opening in a bag can be closed to prevent items from falling out. Straps of various types have been developed over the years which wrap or enclose items of bundles or openings in bags and which tie so as to retain the items in bundles or to close the openings in the bags. Many of the tie straps have a strap and a locking head mounted at an end of the strap. The locking head securably receives the other free end of the strap.

These prior art tie straps generally fall into one of two types in the design of their locking head portions. One type of tie strap device is not reusable and has a locking head which continuously surrounds and encloses a strap which is not releasable therefrom. Representative examples of these types of tie strap devices are disclosed in U.S. Pat. No. 5,267,373 to Chisek, U.S. Pat. No. 5,295,285 to Shely, U.S. Pat. No. 5,517,727 to Bernard et al. and U.S. Pat. No. 5,621,949 to Wells et al.

The other type of tie strap device is reusable and has a locking head which is discontinuous around a strap and defines a longitudinal opening allowing for release of the strap. Representative examples of these types of tie strap devices are disclosed in U.S. Pat. No. 3,086,265 to Orenick et al., U.S. Pat. Nos. 3,147,522 and 3,206,814 to Schumm, U.S. Pat. No. 3,339,247 to Geisinger and U.S. Pat. No. 4,418,448 to Sauer. While both types of prior art tie strap devices appear to be satisfactory in use for the specific purposes for which they were designed, none of them seem to be both reusable and have a locking head which is substantially continuous around a strap thereof.

Consequently, a need still exists for a tie strap device which provides a solution to the aforementioned problem in the prior art without introducing any new problems in place thereof.

SUMMARY OF THE INVENTION

The present invention provides a tie strap device designed to satisfy the aforementioned need. The tie strap device of the present invention is both reusable and has a locking head which is substantially continuous around a strap thereof. The locking head has a line of weakness. The line of weakness is breakable for removal of the strap. The device is reusable after breaking the line of weakness. The locking head forming the line of weakness may have one of three different embodiments in accordance with the principles of the present invention.

Accordingly, the present invention is directed to a tie strap device which comprises: (a) an elongated body of substantially yieldably resilient deformable and reformable material, the elongated body including (i) an elongated strap being substantially flat and having opposite longitudinal surfaces and opposite ends, one of the opposite ends being free, and (ii) a locking head formed at the other of the opposite ends of the strap opposite from the free end and extending therefrom and defining a cavity therethrough having an interior surface, the locking head having portions connected together and defining a line of weakness in the locking head in communication with the cavity, the line of weakness in the locking head permitting separation of the portions from one another and forcible removal of the strap from the cavity in response to a pulling force applied by the strap on the locking head at the line of weakness; and (b) retention means on the locking head and strap for forming a locking engagement between the strap and locking head preventing withdrawal of the strap from the cavity in a direction opposite to a direction of insertion of the strap through the cavity. The yieldably resilient deformable and reformable material of the elongated body is plastic.

In a first embodiment, the locking head defines a substantially wedge-shaped recess continuous with the cavity and disposed directly below the line of weakness of the locking head. In a second embodiment, the locking head defines a substantially wedge-shaped notch or cutout symmetrically with and along the line of weakness. In a third embodiment, the line of weakness is formed by a pair of opposite facing interior side walls provided in the locking head which releasably interconnect with one another. The opposite facing side walls of the line of weakness define and form releasably interlocking recesses and protrusions.

The retention means includes a series of grooves defined on at least one of the opposite longitudinal surfaces of the strap and at least one locking element mounted on and extending from the interior surface of the locking head for locking insertion into one of the series of grooves defined on the one opposite surface of the strap upon insertion of the free end of the strap through the cavity. The series of grooves are inclined in the direction opposite to the direction of insertion of the strap through the cavity. The one locking element of the retention means is inclined in the direction of insertion of the strap through the cavity for lockably mating with one of the series of grooves.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 3:
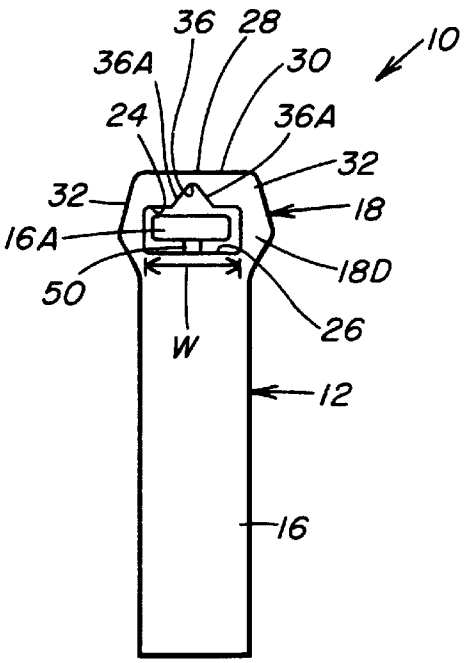
FIG. 3 is an end elevational view of the device as seen along line 3—3 of FIG. 2.
Figure 1:
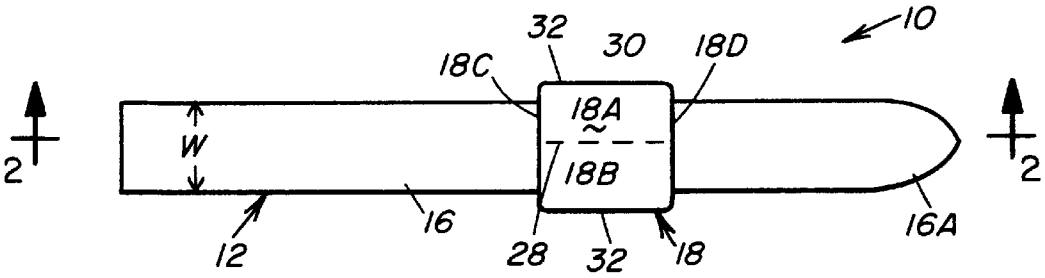
FIG. 1 is a top plan view of a first embodiment of a line of weakness of a locking head on an elongated body of a tie strap device of the present invention.
Figure 2:
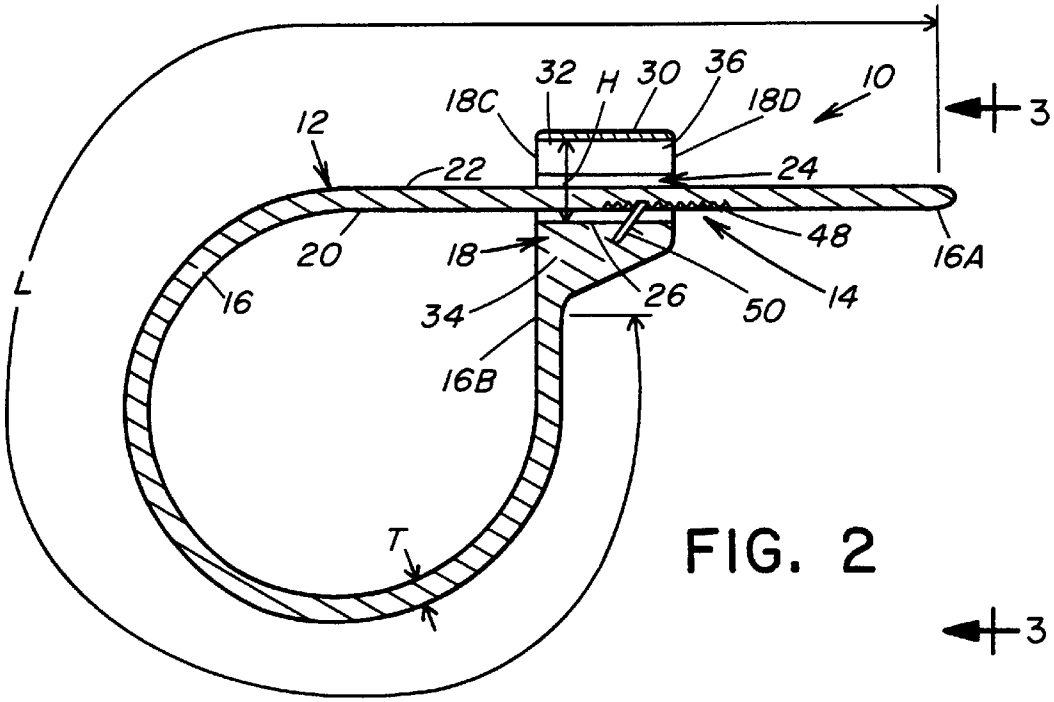
FIG. 2 is a longitudinal sectional view of the tie strap device taken along line 2—2 of FIG. 1.

Referring to the drawings and particularly to FIGS. 1 to 3, there is illustrated a tie strap device, generally designated 10, of the present invention. Basically, the tie strap device 10 includes an elongated body 12 of substantially yieldably resilient deformable and reformable material and a retention means 14. The elongated body 12 includes an elongated strap 16 and a locking head 18. The strap 16 has opposite longitudinal surfaces 20, 22 and opposite ends 16A, 16B. The one end 16A is free. The locking head 18 is formed at the other end 16B of the strap 16 and extends therefrom and defines a cavity 24 therethrough. The cavity 24 has an interior surface 26 from which extends one component of the retention means 14 which will be described below.

The locking head 18 has longtudinal portions 18A, 18B extending between opposite first and second ends 18C, 18D of the locking head 18 which are connected together and define a line of weakness 28 in the locking head 18 in communication with the cavity 24 which extends between the opposite first and second ends 18C, 18D of the locking head 18. The line of weakness 28 allows for separation of the portions 18A, 18B from one another and forcible removal of the strap 16 from the cavity 24 in response to a pulling force applied by the strap 16 on the locking head 18 at the line of weakness 28.

The strap 16 of the elongated body 12 preferably has a substantially flat configuration, though may have any other suitable shape. The strap 16 has a length L, a width W and a thickness T. The length L can be of any suitable size. The length L is preferably substantially greater than the width W. The width W can be of any suitable size, though is preferably substantially less than the length L and is preferably substantially greater than the thickness T. The thickness T can be of any suitable size, though is preferably substantially less than the width W so as to give the strap 16 the preferred substantially flat configuration. The strap 16 has a substantially rectangular configuration in transverse cross-section, though need not be so limited. The free end 16A of the strap 16 converges to a point, though need not be so limited, for ease in insertion of the free end 16A into the cavity 24 of the locking head 18.

The portions 18A, 18B of the locking head 18 of the elongated body 12 together have a substantially box-like configuration, though may have any other suitable shape. The portions 18A, 18B of the locking head 18 together form a top wall 30, a pair of opposite side walls 32 and a bottom wall 34. The top wall 30 has the line of weakness 28. The side walls 32 may be oppositely bowed or convex in shape, though need not be so limited. The first and second end 18C, 18D are open to the cavity 24. The free end 16A of the strap 16 is particularly inserted at the open first end 18C, passes through the cavity 24 and extends beyond the open second end 18D. The bottom wall 34 is integral with the strap 16. The cavity 24 is centrally disposed in and through the locking head 18 between and through each of the open first and second ends 18C, 18D, though need not be so limited. The cavity 24 has a substantially rectangular configuration, though need not be so limited, which conforms to the transverse configuration of the strap 16 for fitting the strap 16 therethrough. The cavity 24 has a height H which is slightly greater than the thickness T of the strap 16 and a width W' which is slightly greater than the width W of the strap 16, though need not be so limited. The yieldably resilient deformable and reformable material of the elongated body 12 is plastic, though need not be so limited.

A first embodiment of the locking head 18 is shown in FIGS. 1 to 3. The line of weakness 28 extends the full length of the top wall 30 of the locking head 18. The line of weakness 28 is centrally disposed lengthwise in the top wall 30, though need not be so limited. The locking head 18 also defines a substantially wedge-shaped recess 36 continuous with the cavity 24 and disposed directly below the line of weakness 28. Opposing sides 36A of the recess 36 converge to a point disposed adjacent to and along the line of weakness 28. The recess 36 makes it easier for a user to force the strap 16 through the line of weakness 28. The line of weakness 28 is constituted merely by the reduction in thickness of the top wall 30 caused by the presence of the wedge-shaped recess 36 or can actually be indentations in or slots through the top wall 30 as can be represented by the dashed line in FIG. 1. In this first embodiment, the device 10 may be reused after the line of weakness 28 is broken, but at a lower working and release limit than before the line of weakness 28 is broken.

Figure 6:
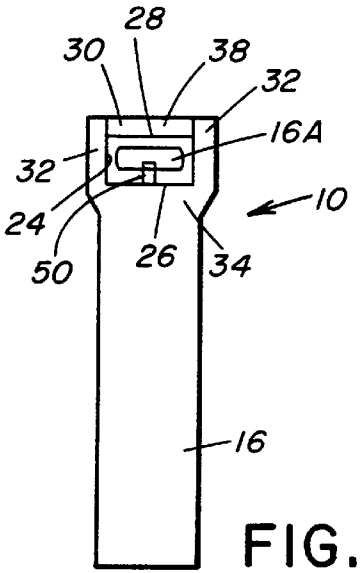
FIG. 6 is an end elevational view of the device as seen along line 6—6 of FIG. 5.
Figure 4:
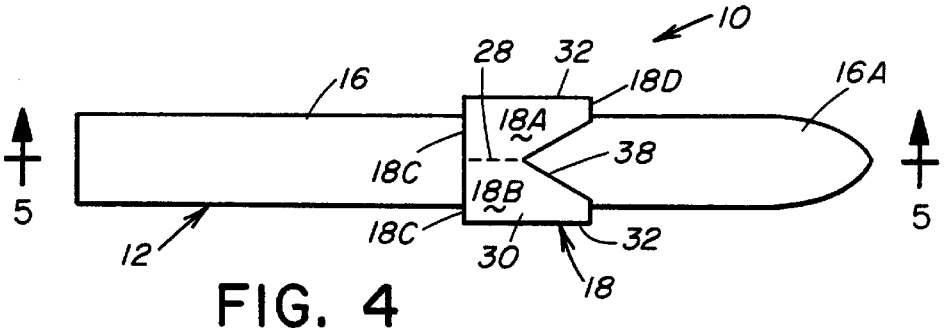
FIG. 4 is a top plan view of a second embodiment of the locking head of the tie strap device of the present invention.
Figure 5:
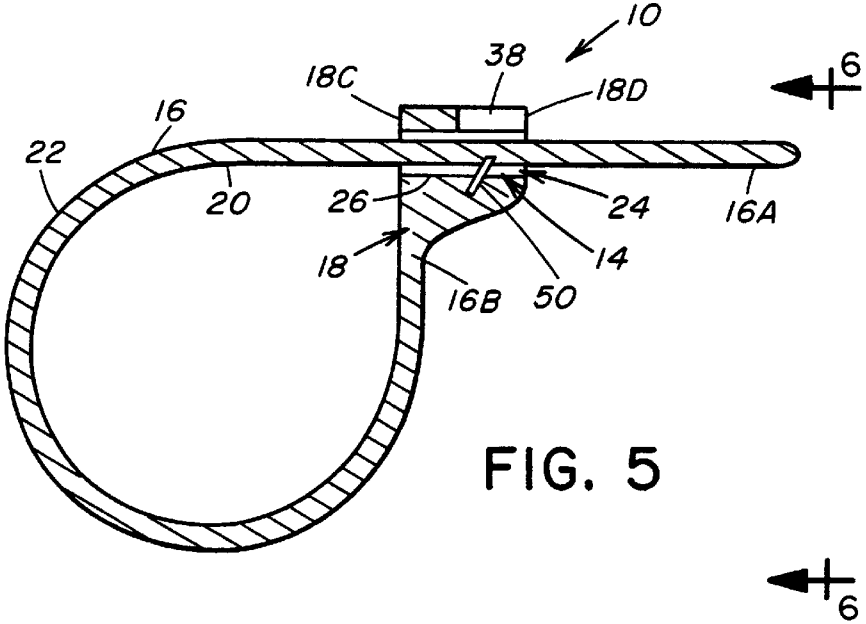
FIG. 5 is a longitudinal sectional view of the tie strap device taken along line 5—5 of FIG. 4.

Referring now to FIGS. 4 to 6, a second embodiment of the locking head 18 is shown. In this second embodiment, the line of weakness 28 extends only a part of the length of the top wall 30 of the locking head 18. The line of weakness 28 is centrally disposed lengthwise in the top wall 30 and extends from the first end 18C interiorly toward but spaced from the second end 18d, though need not be so limited. The locking head 18 here does not define the recess 36 as in the first embodiment of the line of weakness 28. The locking head 18 of the elongated body 12 rather defines a substantially wedge-shaped notch or cutout 38 symmetrically with and along the line of weakness 28. The cutout 38 extends from the second end 18D interiorly and converges to a point spaced from the first end 18C, though need not be so limited. The point of convergence of the cutout 38 is at one end of the line of weakness 28. The cutout 38 makes it easier for the user to force the strap 16 through the line of weakness 28. The line of weakness 28 may be constituted by indentations in or slots through the top wall 30 as can be represented by the dashed line in FIG. 1. In this second embodiment, the device 10 may be reused after the line of weakness 28 is broken, but at a lower working and release limit than before the line of weakness 28 is broken.

Figure 7:
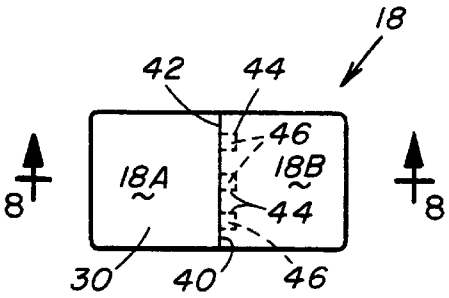
FIG. 7 is an enlarged top plan view of a third embodiment of the locking head of the tie strap device of the present invention showing only a portion of the locking head with releasably interlocking recesses and protrusions of opposite facing sides of the line of weakness of the locking head shown in phantom.
Figure 8:
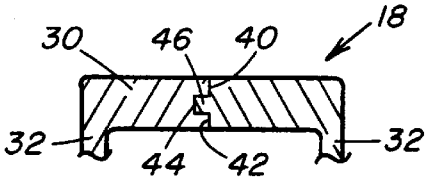
FIG. 8 is a cross sectional view of the portion of the locking head of the device taken along line 8—8 of FIG. 7.

Referring now to FIGS. 7 and 8, a third embodiment of the locking head 18 is shown. In this third embodiment, the locking head 18 has a pair of opposite facing interior side walls 40, 42 which releasably interconnect with one another and extend between the opposite first and second ends 18C, 18D of the locking head 18 to thereby form the line of weakness 28. The opposite facing side walls 40, 42 define and form releasably interlocking pockets 44 and protrusions 46. The pockets 44 are defined on the one side wall 40, though need not be so limited. The pockets 44 are spaced apart from one another. The protrusions 46 are formed on the other side wall 42, though need not be so limited. The protrusions 46 are spaced apart from one another by the same distance as the pockets 44 such that the pockets 44 are aligned with the protrusions 46. Each pocket 44 has a substantially cylindrical configuration, though need not be so limited. Each protrusion 46 likewise has a substantially cylindrical configuration, though need not be so limited, but must be mateably insertable within one of the pockets 44.

Thus, each protrusion 46 has a size slightly less than that of each pocket 44 for fitting therewithin.

Referring now to FIGS. 2, 3, 5 and 6, in an exemplary embodiment the retention means 14 includes a series of grooves 48 and at least one locking element 50. These components are applied on the one interior surface 26 of the locking head 18 and on at least one of the opposite longitudinal surfaces 20, 22 of the strap 16 for forming a locking engagement between the strap 16 and locking head 18 and thereby preventing withdrawal of the strap 16 from the cavity 24 in a direction opposite to a direction of insertion of the strap 16 through the cavity 24. More particularly, the series of grooves 48 are preferably defined on the one longitudinal surface 20 of the strap 16, though may be defined on either of the opposite longitudinal surfaces 20, 22. The one locking element 50 extends from the interior surface 26 of the locking head 18 and is for locking insertion into one of the series of grooves 48 defined on the one opposite surface 20 or 22 of the strap 16 upon insertion of the free end 16A of the strap 16 through the cavity 24. The locking element 50 preferably extends from the bottom wall 34 of the locking head 18, but may alternatively extend from some other region of the locking head 18 depending on the location of the series of grooves 48 on the strap 16.

The series of grooves 48 are particularly inclined in the direction opposite to the direction of insertion of the strap 16 through the cavity 24. The locking element 50 is inclined in the direction of insertion of the strap 16 through the cavity 24 for lockably mating with one of the series of grooves 48. Each groove 48 extends between opposite longitudinal sides of the strap 16 and has a substantially slanted, narrow configuration, though need not be so limited. Each locking element 50 likewise has a substantially slanted, flat configuration, though need not be so limited, but must be mateably insertable within a groove 48. Each locking element 50 has a size slightly less than a size of a groove 48 for fitting therewithin.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A tie strap device, comprising:

(a) an elongated body of substantially yieldably resilient deformable and reformable material, said elongated body including (i) an elongated strap being substantially flat and having opposite longitudinal surfaces and opposite ends, one of said opposite ends being free, and (ii) a locking head formed at the other of said opposite ends of said strap opposite from said free end and extending therefrom, said locking head defining a cavity therethrough having an interior surface, said locking head having portions connected together and defining a line of weakness in said locking head in communication with said cavity, said line of weakness in said locking head permitting separation of said portions from one another and forcible removal of said strap from said cavity in response to a pulling force applied by said strap on said locking head at said line of weakness; and (b) retention means on said locking head and strap for forming a locking engagement between said strap and locking head preventing withdrawal of said strap from said cavity in a direction opposite to a direction of insertion of said strap through said cavity.

2. The device of claim 1 wherein said substantially yieldably resilient deformable and reformable material of said elongated body is plastic.

3. The device of claim 1 wherein said locking head has a substantially wedge-shaped recess continuous with said cavity and disposed directly below said line of weakness of said locking head.

4. The device of claim 3 wherein said line of weakness is constituted by a reduction in thickness of a portion of said locking head.

5. The device of claim 1 wherein said locking head has a substantially wedge-shaped cutout aligned with said line of weakness of said locking head.

6. The device of claim 1 wherein said line of weakness is constituted by a reduction in thickness of a portion of said locking head.

7. The device of claim 1 wherein said line of weakness is a series of indentations in a portion of said locking head.

8. The device of claim 1 wherein said line of weakness is a series of slots through a portion of said locking head.

9. The device of claim 1 wherein said locking head has a pair of opposite internal facing side walls which releasably interconnect with one another so as to form said line of weakness in said locking head.

10. The device of claim 9 wherein said opposite facing side walls of said locking head define and form releasably interlocking pockets and protrusions.

11. The device of claim 1 wherein said retention means includes:

a series of grooves defined on at least one of said opposite longitudinal surfaces of said strap; and at least one locking element extending from said interior surface of said locking head for locking insertion into one of said grooves defined on said at least one opposite surface of said strap upon insertion of said free end of said strap through said cavity.

12. A tie strap device, comprising:

(a) an elongated body of substantially yieldably resilient deformable and reformable material, said elongated body including (i) an elongated strap being substantially flat and having opposite longitudinal surfaces and opposite ends, one of said opposite ends being free, and (ii) a locking head formed at the other of said opposite ends of said strap opposite from said free end and extending therefrom, said locking head defining a cavity therethrough having an interior surface, said locking head having portions connected together and defining a line of weakness in said locking head in communication with said cavity, said line of weakness in said locking head permitting separation of said portions from one another and forcible removal of said strap from said cavity in response to a pulling force applied by said strap on said locking head at said line of weakness, said locking head also defining a substantially wedge-shaped cutout along said line of weakness; and (b) retention means on said interior surface of said locking head and on at least one of said opposite longitudinal surfaces of said strap for forming a locking engagement between said strap and locking head preventing withdrawal of said strap from said cavity in a direction opposite to a direction of insertion of said strap through said cavity.

13. The device of claim 12 wherein said substantially yieldably resilient deformable and reformable material of said elongated body is plastic.

14. The device of claim 12 wherein said retention means includes:

a series of grooves defined on at least one of said opposite longitudinal surfaces of said strap; and at least one locking element extending from said interior surface of said locking head for locking insertion into one of said grooves defined on said at least one opposite surface of said strap upon insertion of said free end of said strap through said cavity.

15. The device of claim 12 wherein said line of weakness is constituted by a reduction in thickness of a portion of said locking head.

16. The device of claim 12 wherein said line of weakness is a series of indentations in a portion of said locking head.

17. A tie strap device, comprising:

(a) an elongated body of substantially yieldably resilient deformable and reformable material, said elongated body including (i) an elongated strap being substantially flat and having opposite longitudinal surfaces and opposite ends, one of said opposite ends being free, and (ii) a locking head formed at the other of said opposite ends of said strap opposite from said free end and extending therefrom, said locking head defining a cavity therethrough having an internal surface, said locking head having portions connected together and defining a line of weakness in said locking head in communication with said cavity, said line of weakness in said locking head permitting separation of said portions from one another and forcible removal of said strap from said cavity in response to a pulling force applied by said strap on said locking head at said line of weakness, said locking head having a pair of opposite internal facing side walls which releasably interconnect with one another so as to form said line of weakness; and (b) retention means on said interior surface of said locking head and on at least one of said opposite longitudinal surfaces of said strap for forming a locking engagement between said strap and locking head preventing withdrawal of said strap from said cavity in a direction opposite to a direction of insertion of said strap through said cavity.

18. The device of claim 17 wherein said substantially yieldably resilient deformable and reformable material of said elongated body is plastic.

19. The device of claim 17 wherein said opposite facing side walls of said locking head defining said line of weakness of said locking head have releasably interlocking recesses and protrusions formed thereon.

20. The device of claim 17 wherein said retention means includes:

a series of grooves defined on at least one of said opposite longitudinal surfaces of said strap; and at least one locking element extending from said interior surface of said locking head for locking insertion into one of said grooves defined on said at least one opposite surface of said strap upon insertion of said free end of said strap through said cavity.

* * * * *